United States Patent [19]

Bode

[11] Patent Number: 4,674,573

[45] Date of Patent: Jun. 23, 1987

[54] METHOD AND APPARATUS FOR PLACING CEMENT PLUGS IN WELLS

[76] Inventor: Robert E. Bode, 902 Fetick, Taft, Tex. 78390

[21] Appl. No.: 773,616

[22] Filed: Sep. 9, 1985

[51] Int. Cl.[4] ..... E21B 33/13

[52] U.S. Cl. ..... 166/291; 166/70; 166/242

[58] Field of Search ..... 166/70, 153, 156, 242, 166/281, 285, 291, 383, 386, 289; 175/72

[56] References Cited

U.S. PATENT DOCUMENTS

| | | | |
|---|---|---|---|
| 1,662,311 | 2/1928 | Hamer | 166/70 |
| 2,071,392 | 2/1937 | Crowell | 166/155 |
| 3,006,415 | 10/1961 | Burns et al. | 166/156 |
| 3,094,175 | 6/1963 | Jackson | 175/324 |
| 3,289,762 | 12/1966 | Schell et al. | 166/281 |
| 3,391,737 | 7/1968 | Havens | 166/289 |
| 3,777,819 | 12/1973 | Delano | 166/285 |
| 4,047,566 | 9/1977 | Duke | 166/155 |
| 4,223,747 | 9/1980 | Marais | 175/324 |
| 4,429,746 | 2/1984 | Allard | 166/70 |

FOREIGN PATENT DOCUMENTS

| | | | |
|---|---|---|---|
| 0898042 | 1/1982 | U.S.S.R. | 166/291 |

*Primary Examiner*—Stephen J. Novosad

*Assistant Examiner*—Terry Lee Melius

*Attorney, Agent, or Firm*—Dodge, Bush & Moseley

[57] ABSTRACT

A plug catcher assembly comprising an elongated adapter sub having threads on its upper end for connecting to the pipe string, a reverse circulation or jet sub threadedly connected to the adapter sub, and a catcher sub threadedly connected to the jet sub for catching plugs.

The catcher sub and the jet sub have a plurality of upwardly and outwardly directed apertures in its wall which are arranged to promote turbulent flow and slurry mixing and to initially direct such slurry flow in the upward direction. The apertures are vertically spaced in the catcher sub so as to prevent pressure locking and to assure that the sub stays free of cement slurry.

The catcher sub can contain and catch as many as eight plugs to save rig time by eliminating tripping of the string between plugging operations.

Additionally, a plug launching apparatus is disclosed for use in launching a plurality of plugs during a cementing operation. Upper and lower restrictions are provided in the bore of the launching sub so that pressure indications are given as a plug passes through a restriction and is launched.

20 Claims, 5 Drawing Figures

METHOD AND APPARATUS FOR PLACING CEMENT PLUGS IN WELLS

FIELD OF THE INVENTION

This invention relates generally to the formation of cement plugs in well bores, and particularly, to new and improved methods and apparatus for plugging a well to be abandoned with one or more columns of cement placed one upon top of the other.

BACKGROUND OF THE INVENTION

A cementing operation often is used to plug the bore of a well that is to be abandoned for any reason, for example where well testing has shown that hydrocarbons are not present in commercial quantities (or not present at all). Similar procedures are used where a well is to be "kicked-off" to change its direction at some point along its path. Typically a pipe string is run into the well bore, and cement slurry is pumped down the pipe. The slurry displaces drilling mud or other fluids in the pipe and passes out the lower end thereof to displace the fluid standing in the annular space between the outer wall of the pipe string and the wall of the borehole. At present, the cement slurry is forced down the pipe string by a following displacement fluid with or without a plug that is used to separate the cement slurry and the displacement fluid. After the cement slurry has been pumped into the annulus, the drill pipe is withdrawn, leaving the slurry at the bottom of the well to set up and harden to form a solid plug.

Ideally, just sufficient cement slurry is pumped into the pipe string to fill the annular space to the required height in a manner such that virtually no slurry is left in the bottom of the inside of the pipe string. This procedure is carried out by placing in the pipe string, above a calculated quantity of cement slurry, a fluid displacement plug which is driven along the pipe string by the application of pressure on top of the plug. The displacement fluid may be a typical substance well known to those skilled in the art. Thus the cement slurry is driven along in front of the plug, as the displacement fluid, behind the plug, is pumped under pressure.

Considerable skill has been required during the cement plugging operation to know precisely when to stop the pumps so that the plug is just reaching the bottom of the pipe string. If pumping is continued after the plug reaches bottom, displacement fluid will be pumped beyond the end of the pipe string and displace the cement slurry from its proper position around the outside of the string. This can result in damage to the cement mix so as to prevent proper setting thereof. Such an occurrence is known as over-displacement. If the converse occurs, and the pumping is discontinued before the plug reaches the bottom, the cement may set in the pipe string and will have to be drilled out at a later stage. Clearly such extra drilling is time consuming and expensive.

Additionally, when the pumps are turned off before withdrawing the pipe string, the weight of the column of cement slurry around the outside of the string may be greater than the weight of column of the displacement fluid inside the string. This situation can cause the cement slurry to flow back down outside the pipe and up into the hollow interior thereof. This effect, known as the "U-tube" effect, may result in cement slurry remaining in the pipe string after its withdrawal, with resulting difficulties as will be apparent.

Known devices have provided a tubular structure that is connected in the pipe string to present an obstruction in the bore thereof. The obstruction may have a shape such that a fluid displacement plug can move past the obstruction under the force of the displacement fluid behind the plug, but which prevents return of the plug back up the pipe. In accordance with the present invention, a restriction is placed at a selected location in the pipe string so that a surge of pressure may be detected at the surface to indicate the precise position of the plug so that pumping can be terminated or reduced immediately upon detection of the pressure surge.

Plug catchers are known that function to trap the cement plug in the lower end of the pipe string. For example a catcher offered by the Halliburton Company, Duncan, Okla., is a latch-down, indicating type plug catcher. In operation, the catcher is placed near the end of the string in the drill pipe and lowered to the desired depth. When the operator is ready to start pumping the cement slurry, a bottom plug placed in the pipe string is started, and the desired amount of cement slurry is pumped behind this plug. The plug will pass through the catcher and out the bottom of the drill pipe. A top plug that is retained in a plug container during displacement of the cement then is released and pumped into the pipe behind the cement slurry. When the plug reaches the catcher, the plug enters a baffle and is locked and sealed in place.

The operator must take precautions at this time so that the differential pressure across the top plug does not exceed a maximum value which would shear the baffle which is held by shear screws. The pipe is then lifted upward until its lower end is at a desired location on top of the cement slurry, and pressure is supplied in the pipe so as to shear the screws and release the baffle. The baffle and plug will then move to the bottom end of the catcher, uncovering ports. The baffle and plug are locked in the lower end of the tool and will remain throughout a reverse circulation process.

After this single plug operation has been performed, the drill pipe must be tripped out of the hole so that the plug catcher can be recovered and disassembled to retrieve the top plug and baffle.

The above-mentioned system has a number of disadvantages which makes its use undesirable. One disadvantage is that the pipe string must be tripped after each plug job so as to retrieve the top plug and baffle in the catcher. Another disadvantage is that it is necessary to disassemble the plug catcher upon its retrieval to replace worn or damaged seals and lock rings. The baffle must then be reassembled in the catcher with new shear screws. Additionally, the ports in the catcher are positioned perpendicular to the axis thereof so as to direct the flow of cement slurry directly against the formation wall. Another disadvantage is that the plug catcher does not provide a means for pumping away the plug member caught therein, if an emergency requiring such an action arises.

A more detailed discussion of cementing heads, plug containers and plug launching subs may be found in the following: U.S. Pat. Nos. 2,071,392, 4,047,566 and 4,164,980. U.S. Pat. No. 3,777,819 discloses a plug container having cement plug valves for driving plug members therethrough.

One object of the present invention is to provide new and improved methods and apparatus for use in placing cement plugs.

Another object of this invention is to provide a new and improved plug catcher adapted for use in a well to catch and contain plug members used in cement plugging operations.

Another object of this invention is to provide a plug catcher of the type described which prevents pressure locking in the plug catcher and assures that the tubular member stays free of cement slurry.

Another object of this invention is to provide a new and improved plug catcher which is assembled from short length component parts to aid in the maintenance, handling and transporting thereof.

Still another object of this invention is to provide a new and improved plug catcher capable of catching and containing a plurality of plug members so as to save rig time and expense by eliminating tripping of the pipe string between plugging operations.

Another object of the present invention is to provide a new and improved cementing plug launching apparatus which comprises no moving parts and which is simple and reliable in operation.

SUMMARY OF THE INVENTION

These and other objects are attained in accordance with the present invention through the provision of a plug catcher assembly comprising an elongated adapter sub having threads on its upper end for connecting to the pipe string, a reverse circulation or jet sub threadedly connected to the adapter sub, and a catcher sub threadedly connected to the jet sub for catching plugs.

The catcher sub has a plurality of upwardly and outwardly directed apertures in its wall which are arranged helically at ninety (90°) degree intervals. The upwardly and outwardly directed holes in the jet sub function to promote turbulent flow and slurry mixing and to initially direct such slurry flow in the upward direction. The apertures in the jet sub are vertically spaced in the sub so as to prevent pressure locking and to assure that the sub stays free of cement slurry. The catcher sub can contain and catch as many as eight plugs to save rig time by eliminating tripping of the string between plugging operations.

Additionally, a plug launching apparatus is disclosed for use in launching a plurality of plugs during a cementing operation. Upper and lower restrictions are provided in the bore of the launching sub so that pressure indications are given as a plug passes through a restriction and is launched.

BRIEF DESCRIPTION OF THE DRAWINGS

The present invention has other objects, advantages and features which will become more readily apparent in connection with the following detailed description, taken in conjunction with the appended drawings in which.

DESCRIPTION OF A PREFERRED EMBODIMENT

Figure 1:
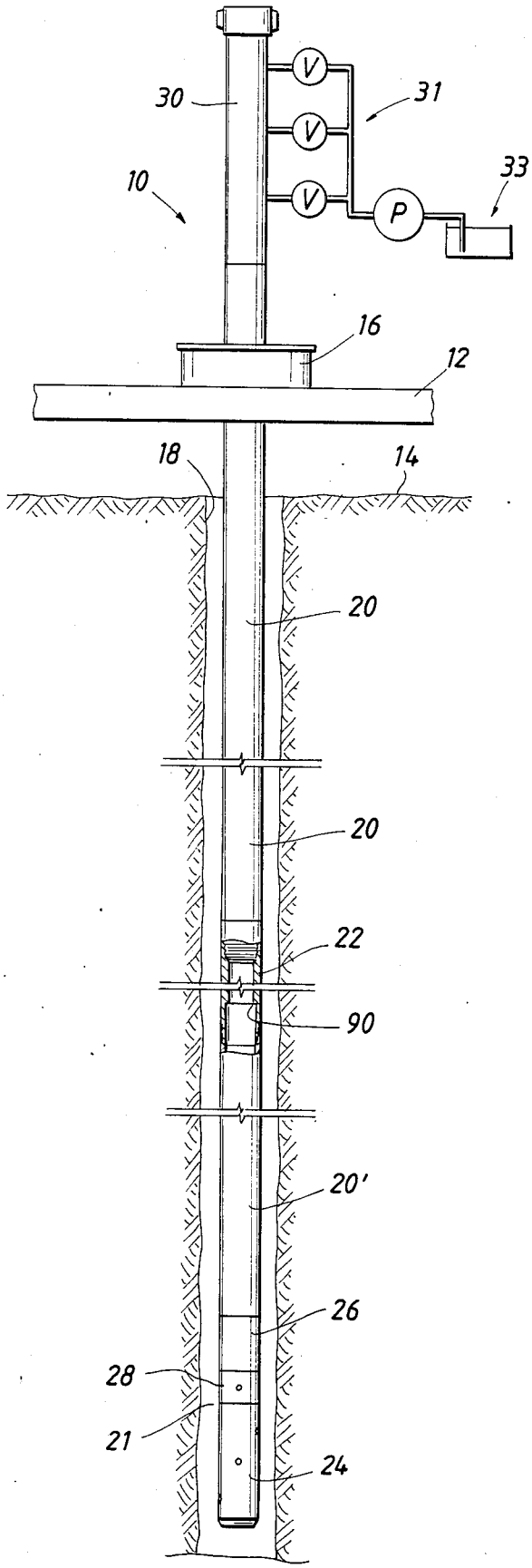
FIG. 1 is a schematic view of a portion of a borehole having apparatus in accordance with this invention disposed therein.

Referring initially to FIG. 1, there is illustrated a drilling rig 10 comprising a floor 12 and a rotary table 16. The rotary table 16 carries a bushing and slips (not shown) for suspending a pipe string 20. The pipe string 20 extends downward into a borehole 18 and is comprised of a plurality of joints of pipe threaded end-to-end.

A flow restriction sub 22 is connected in the pipe string 20 a selected distance, for example 300 feet, above a plug catcher assembly 24 located at the lower end of the pipe string. An adapter sub 26 and a reverse circulating or jet sub 28 are threadedly connected between the plug catcher sub 24 and the section of pipe 20′ that extends upward to the restriction sub 22.

A cement plug launching sub 30 is connected to the upper end of the pipe string 20 and has a manifold, indicated generally at 31, connected thereto. The manifold 31 having valves V leads to a pump P that supplies fluids under pressure taken from a mixing hopper 33 or the like.

Figure 2:
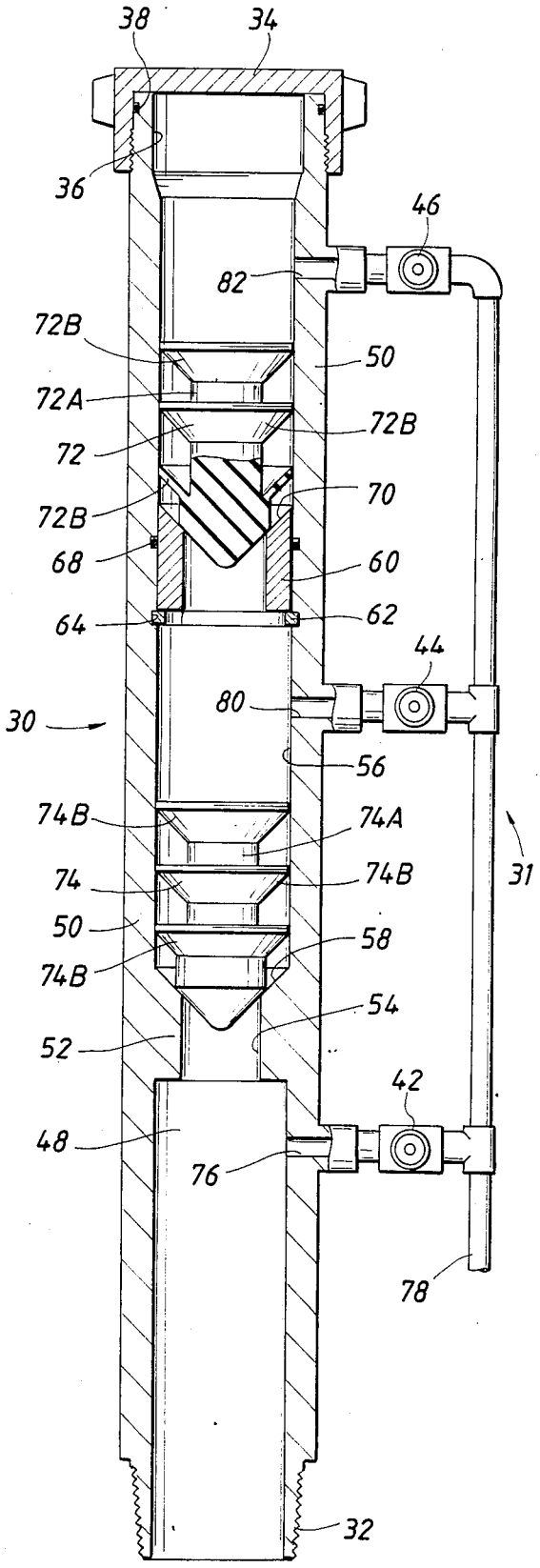
FIG. 2 is a cross-sectional view, with portions in side elevation, illustrating the launching sub shown schematically in FIG. 1.

Referring now to FIG. 2, the launching sub 30 is shown in greater detail. The launching sub 30 includes a tubular body 50 having a threaded pin 32 at its lower end. A cap 34 may be threaded onto the upper end 36 of the body 50 or a cap that is threaded inside the upper end of the body may be used. An O-ring seal 38 is used to make the connection fluid-tight. A series of vertically spaced ports 76, 80 and 82 extend through the wall of the body and are connected to respective lines, as shown, having valves 42, 44 and 46 therein. The lines lead to a common trunk 78 which is connected to the outlet of the pump P.

The body 50 is provided with upper and lower restrictions 52 and 60, respectively. The lower restriction 52 has an inner wall 54 of lesser diameter than the diameter of the wall 56 of the body 50, and has a downwardly and inwardly inclined surface 58 on its upper side. The restriction 52 can be formed as an integral part of the body 50, or alternatively could be fabricated as a sleeve which would be fixed in a suitable manner inside the body 50. The upper restriction, in the form of a sleeve 60, rests on a keeper ring 62 that is received in groove 64 in the body 50. An O-ring 68 prevents fluid leakage past the sleeve 60. The sleeve 60 has an upper surface 70 that is inclined downwardly and inwardly.

A pair of cement plugs 72 and 74 are shown resting on the respective restrictions 60 and 52. Plugs 72, 74 are made of an elastomeric material and have central bodies 72A, 74A with a plurality of upwardly facing cups 72B, 74B with outer edges that engage the borewall 56 so that fluid pressure above the plugs will force them in a downward direction.

If one plug is to be used, a volume of cement slurry can be pumped into the bore 48 and into the pipe string 20 below the plug 74 by opening the valve 42 and closing the valves 44 and 46. To launch the plug 74, the valve 42 is closed, and a circulating fluid is pumped in through the valve 44. The pressure of the circulating fluid forces the plug 74 through the restriction 52, and a substantial change in fluid pressure registered on a gauge (not shown) at the pump provides a clear indication that the plug is launched. If two plugs are to be used, one on each side of the slurry, the procedure to be explained below is followed.

When the plug 74 reaches the downhole restriction 22, another pump pressure surge or increase signals the fact of arrival of the plug at that location. Normally, a sufficient volume of cement slurry will have been placed in the pipe such that the cement has exited to the annulus 21 via the catcher sub 24, and will have filled the annulus 21 to a level just above the restriction sub 22.

Figure 3A:
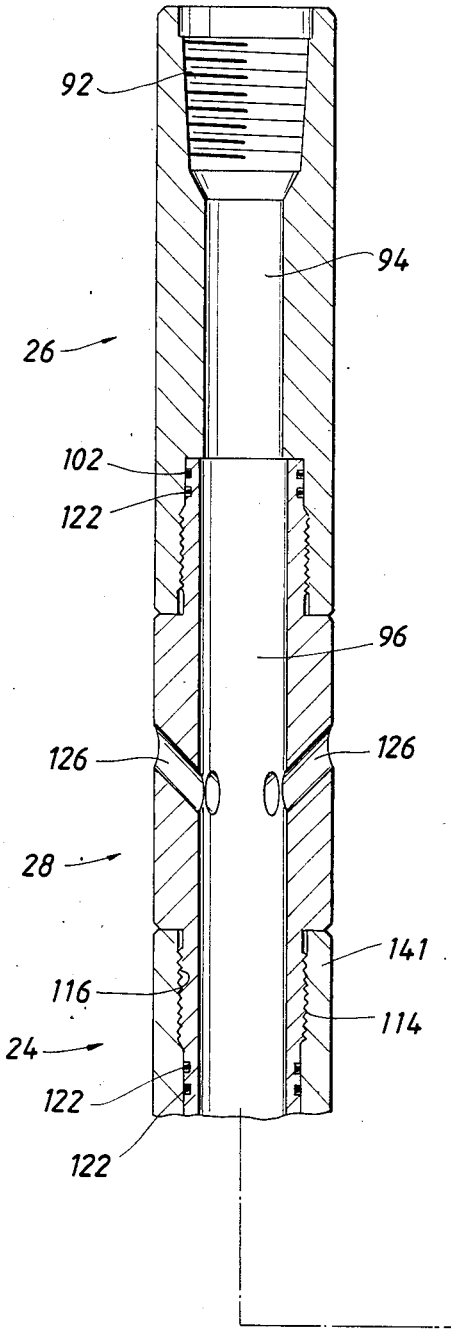
FIGS. 3A and 3B are cross-sectional views of the plug catcher of this invention, FIG. 3A forming an upper continuation of FIG. 3B.
Figure 3B:
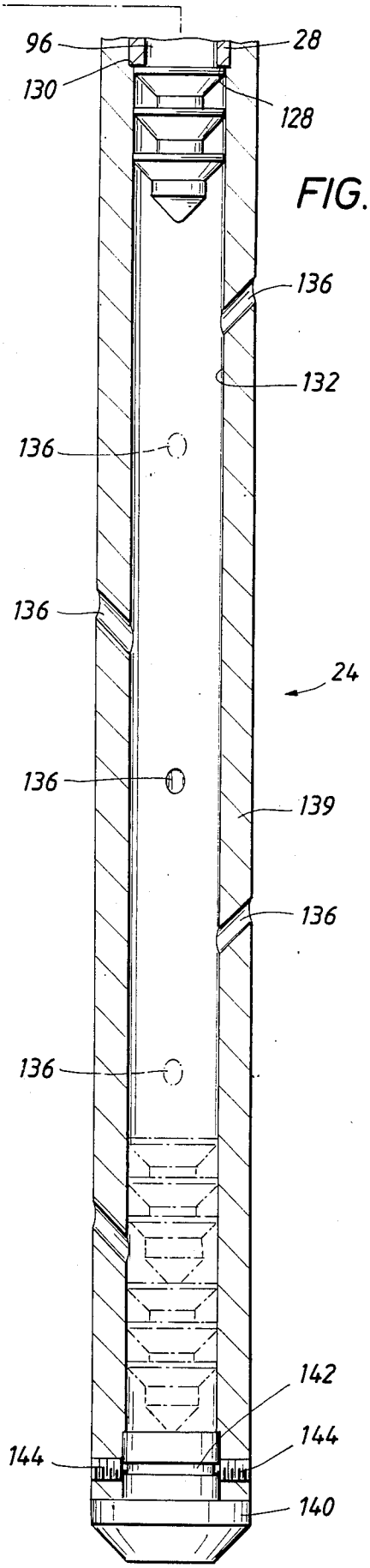

Turning now to FIGS. 3A and 3B, the catcher assembly 24 includes an elongated tubular member 139, having a nose 140 that closes its lower end. The nose 140 can be attached by shear screws 144 that extend into an external annular groove 142 in the nose. The upper end 141 of the member 139 is provided with internal threads 116 which receive threads 114 on a male element or pin on the lower end of the reverse circulating or jet sub 28.

The sub 28 has a plurality of ports 126 that are directed upwardly and outwardly at an angle of about 45° to communicate the bore 96 of the sub 28 with the annulus 21. The upper pin end of the sub 28 is threaded to the adapter sub 26 as shown, and seals 102 and 122 are used to prevent fluid leakage. The adapter sub 26 has a threaded box 92 at its upper end having companion threads to those used in the pipe string 20.

As shown at the upper end of FIG. 3B, the lower surface 128 of the sub 28 provides a downwardly facing shoulder defining a lesser internal diameter than the adjacent inner surface 132 of the tubular member 139. A series of vertically spaced flow ports 136 extend through the wall of the member 139, with each port being inclined upwardly and outwardly at an angle of about 45°. The ports 136 may be formed on a helical line around the periphery of the member 139 at 90° intervals. The apertures 136 are spaced apart vertically to prevent pressure locking of a plug in the tubular member 139.

Each of the apertures in the jet sub and the catcher are inclined upwardly and outwardly to promote turbulent flow and slurry mixing and to direct such flow in an upward direction. The catcher assembly 24 is shown having sufficient length to catch and contain eight cement plugs. As each plug is pumped into the member 139, the plug is forced to a lower position shown in phantom lines as the cement slurry is displaced into the annulus via the ports 126 and 136. The plugs will be prevented from upward movement, as shown in solid lines, by shoulder 128.

In an emergency, a pressure greater than normally used in cementing operations which, in the preferred embodiment is about 4,000 psi, will cause the pins 144 to shear so that the aluminum nose 140 can fall to the bottom of the bore 18.

Figure 4:
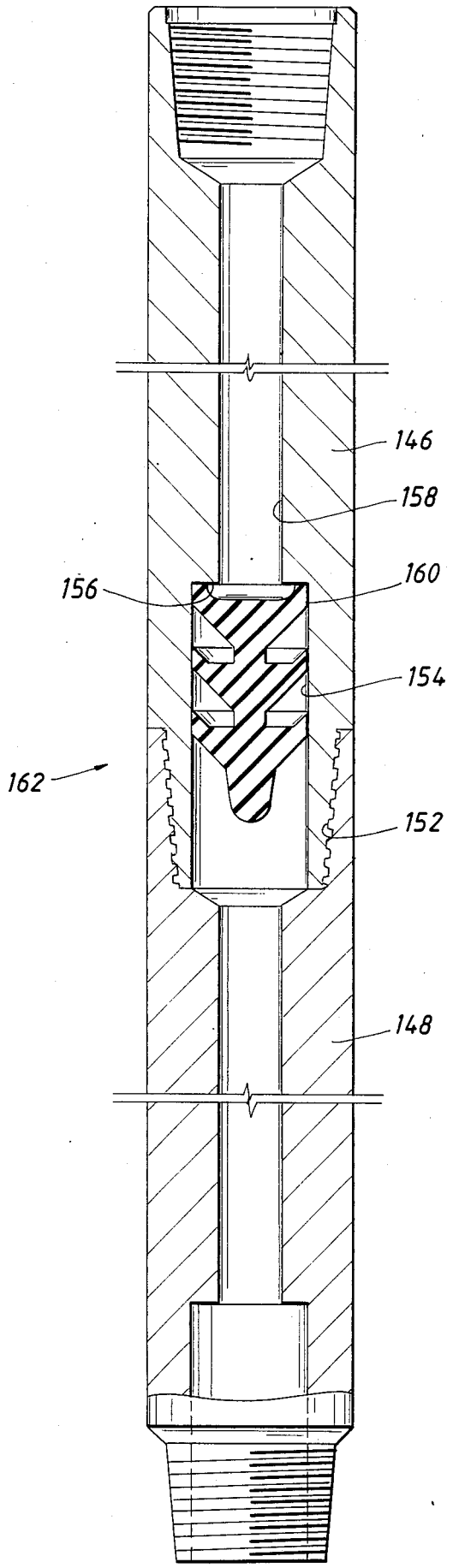
FIG. 4 is a cross-sectional view illustrating an alternative embodiment of a flow restriction means located in the pipe string.

Turning now to FIG. 4, an improved restriction sub 162 is illustrated which comprises a first tubular member 146 and a second tubular member 148 which are threaded together at 152. The tubular member 146 is provided with a counterbore 154 which provides a downwardly facing shoulder 156. An indication is given at the surface by a rise in pump pressure that the plug 160 has entered the restricted bore 158. Upward movement of the plug member 160 is prevented by the shoulder 156 to prevent the "U-tube" effect. This improvement is particularly useful in offshore wells since it provides lighter and more easily handled members which are approximately three feet in length from box end to pin end.

OPERATION

In operation, the assembled catcher sub 24, jet sub 28, and adapter sub 26 are threaded to the lower end of the pipe section 20' and lowered into the well. The restriction sub is connected in the pipe string a selected distance, for example 300 feet, or ten pipe joints, above the catcher assembly. Alternatively, the restriction sub is positioned one to two joints below the proposed top of the cement plug. The catcher assembly then is lowered until the nose thereof is either on bottom, or just off-bottom. Then the plug launcher is attached to the upper end of the pipe string, which is hung-off or suspended in the slips of the rotary bushing. The two cement plugs are positioned in the launcher, as shown, and the cap put on.

A well fluid is then pumped into the pipe string 20 via the opening 76 to clean up and condition the well in a typical manner. The bottom dart or plug member 74 is then released by application of pressurized cement slurry via the valve 44, with the plug providing an interface between the cement and the well fluid. The desired volume of cement slurry is pumped behind the plug 74, and upper plug 72 is then launched. The fact of launch is indicated on the pump pressure gauge as each plug is driven past the restrictions. Preferably the pressure used to drive the plugs is 300 to 400 psi. The top plug member also provides an interface that prevents contamination of the cement with displacement fluid. As the plug members travel downward, they internally wipe the drill pipe clean, leaving substantially no cement on the wall of the pipe.

The cement slurry is displaced to within about one barrel of the flow restriction sub 22 or improved sub 162, and the pump rate is reduced to one barrel per minute. A surface indication is obtained of the arrival of the plug member 74 at the restriction sub 22, which is a known distance above the catcher sub 24. Another indication is given when the upper plug 72 reaches the restriction, at which time the pump is stopped. The level of cement in the annulus will be just above the restriction sub 22, and the upper plug will engage the shoulder 90 or 156 to prevent back-flow or the previously described "U-tube" effect.

The pipe string 20 is then pulled above the cement plug, a distance substantially equal to the selected distance of 300 feet, while pumping the upper plug member 72 downwardly to empty the pipe section 20' and the catcher sub 24 of cement. The upper plug member is pumped down into the catcher sub 24 and the surface blowout preventers are then closed. The pipe string 20 can be cleaned by reverse circulation of fluid down the annulus and into the pipe via the reversing ports 126. A column of cement approximately 300 feet in height is allowed to set up or harden to form a plug in the borehole.

If additional cement plugs are desirable, they can be formed on top of the previously set plug using the same procedures outlined above without tripping the string because of the new catcher sub 24.

It now will be recognized that new and improved cement plug forming methods and apparatus have been disclosed. There is a considerable saving in rig time and costs, since tripping of the pipe between plugging phases is eliminated. The direction of injection of the cement slurry into the annulus is at an upwardly and outwardly angle to provide improved slurry mixing due to a turbulent flow, and to reduce the possibility of the cement migrating downhole.

Since various changes and modifications may be made in the disclosed apparatus and methods without departing from the inventive concepts involved, it is the aim of the appended claims to cover all such changes and modifications falling within the true spirit and scope of the present invention.

What is claimed is:

1. Apparatus adapted for use in a well to catch and contain a plug member used in a cementing operation, comprising: an elongated tubular member having means at its upper end for connecting said member to a pipe string, said member having an internal bore sized to receive and catch a cement plug, downwardly facing shoulder means at the upper end of said bore for catching a cement plug by preventing its upward movement past said shoulder means, and a plurality of longitudinally spaced apertures through the wall of said tubular member for permitting flow of cement slurry from said bore to the annulus outside said member, each of said apertures being inclined upwardly and outwardly to promote turbulent flow and slurry mixing and to direct such flow in an upward direction.

2. The apparatus of claim 1, further including a reverse circulating sub threadedly connected to the upper end of said tubular member, said sub having at least one upwardly and outwardly directed circulating port through the wall thereof.

3. The apparatus of claim 2, further including flow restriction means connected in said pipe string a preselected distance above said tubular member, said restriction means functioning to cause a pressure increase that can be detected at the surface to provide an indication that a cement plug has reached the restricted bore thereof.

4. The apparatus of claim 3, further including cement plug launching means connected to said pipe string at the upper end thereof, said launching means including: an elongated tubular body closed at its upper end, longitudinally spaced upper and lower restriction means in said body, means for admitting cement slurry into said body at a first location below said lower restriction means, means for admitting cement slurry into said body at a second location between said upper and lower restriction means, and means for admitting cement slurry into said body at a third location above said upper restriction means.

5. The apparatus of claim 1 wherein said apertures are spaced longitudinal a distance greater than the axial length of a plug member to prevent pressure locking of a plug member in said tubular member.

6. The apparatus of claim 1 wherein said connecting means comprises a reverse circulating sub having at least one port extending through the wall thereof, said reversing sub being threadedly connected to said tubular member to permit replacement in the event of washout of said port.

7. The apparatus of claim 6 wherein said connecting means comprises an adapter sub threadedly connected between said circulating sub and said pipe string.

8. The apparatus of claim 5, wherein said apertures are arranged along a spiral path at 90° intervals.

9. The apparatus of claim 1, wherein said apertures are inclined at 45° to the axis of said tubular member.

10. The apparatus of claim 1, wherein said tubular member has an axial length designed to catch and contain at least eight cement plugs to save rig time by eliminating tripping of the pipe string between cementing operations.

11. The apparatus of claim 1, further including a closure means at the lower end of said tubular member for limiting downward movement of a plug through said tubular member.

12. The apparatus of claim 11, further including shear pin means for coupling said closure member to said tubular member, said shear pin means being disrupted in response to a pressure greater than pressures normally used in cementing operations.

13. A method of setting a cement plug in a well bore, comprising the step of: (a) connecting a tubular catcher member to a lower end of a pipe string, and lowering the pipe string and catcher member into a well bore, (b) placing a volume of cement slurry in the pipe string, (c) positioning a first plug member adjacent the upper surface of said volume of said slurry, (d) pumping the cement slurry and said plug member downwardly through the pipe string, (e) providing a surface indication of the arrival of said plug member at a location a selected distance above the tubular catcher member, (f) stopping the pumping of the cement slurry and the plug member upon arrival of the plug member at said location, (g) preventing upward movement of the plug member after the pumping is stopped, (h) lifting said pipe string together with said catcher member a distance substantially equal to said selected distance while pumping said plug member downwardly, (i) catching said first plug member in the tubular catcher, (j) reverse circulating well fluids through said pipe string to clean the bore thereof, and then (k) repeating steps b, c, d, e, f, g and h without removing the string from the well bore, and (l) catching said plug members in said catcher member.

14. The method of claim 13, further comprising the step of: directing said cement slurry upwardly.

15. Apparatus adapted for use in launching a plug member into a pipe string during a cementing operation, comprising: an elongated tubular body closed at its upper end, said body having a central passageway, means for connecting the lower end of said tubular body to a pipe string, first reduced diameter restriction means in said passageway for impeding the passage of a plug member through said passageway, means for admitting fluid into said passageway at a first location below said first restriction means, and means for admitting cement slurry into said passageway at a second location above said first restriction means.

16. The apparatus of claim 15, further including: second reduced diameter restriction means in the central passageway above said first restriction means for impeding the passage of a plug member therethrough, and means for admitting fluid into said passageway at a third location above said second restriction means.

17. The apparatus of claim 16 wherein said second restriction means is formed by a sleeve, and means for removably mounting said sleeve on said body.

18. The apparatus of claim 17 wherein said mounting means includes a ring abutting the lower end of said sleeve.

19. A method of launching a plug into a pipe string comprising the steps of: (a) providing an elongated tubular body having a central passageway, (b) providing a lower reduced diameter restriction means in said passageway for impeding the passage through said passageway of a plug member, (c) loading a first elastomeric plug member into said body above a said lower restriction means, said plug member having an outer diameter greater than the inner diameter of said lower restriction means, (d) pumping fluid through a first opening above said lower restriction means into said passageway, and (e) forcing said plug member through said restriction means in response to the pressure of said fluid.

20. The method of claim 19, comprising the further steps of: providing an upper reduced diameter restriction means in said passageway, loading a second elastomeric plug member into said body above the upper restriction means, said second plug member having an outer diameter greater than the inner diameter of said upper restriction means, pumping pressurized fluid through a second opening into said passageway, said second opening extending through the wall of said body above said upper restriction means, and driving said second plug member through both said upper and said lower restriction means with said pressurized fluid.

* * * * *